US005260968A

United States Patent [19]

Gardner et al.

[11] Patent Number: 5,260,968

[45] Date of Patent: Nov. 9, 1993

[54] METHOD AND APPARATUS FOR MULTIPLEXING COMMUNICATIONS SIGNALS THROUGH BLIND ADAPTIVE SPATIAL FILTERING

[75] Inventors: William A. Gardner, Yountville; Stephan V. Schell, Davis, both of Calif.

[73] Assignee: The Regents of the University of California, Oakland, Calif.

[21] Appl. No.: 903,627

[22] Filed: Jun. 23, 1992

[51] Int. Cl.[5] ..... H04K 1/00

[52] U.S. Cl. ..... 375/1

[58] Field of Search ..... 375/1

[56] References Cited

U.S. PATENT DOCUMENTS

| | | | |
|---|---|---|---|
| 3,754,101 | 8/1973 | Daspit et al. | 375/1 |
| 4,189,677 | 2/1980 | Cooper et al. | 375/1 |
| 4,222,115 | 9/1980 | Cooper et al. | 375/1 |
| 4,855,747 | 8/1989 | Steinberg . | |
| 4,860,279 | 8/1989 | Falk et al. . | |
| 4,882,775 | 11/1989 | Coleman . | |
| 4,956,834 | 9/1990 | Coleman . | |

OTHER PUBLICATIONS

J. Winters; "Optimum Combining in Digital Mobile Radio With Cochannel Interference"; Aug. 1984; *IEEE Transactions on Vehicular Technology* vol. VT-33, No. 3.

P. S. Henry, B. S. Glance; "A New Approach to High--Capacity Digital Mobile Radio"; Oct. 1981; The Bell System Technical Journal, vol. 60, No. 8.

Yu-Shuan Yeh, D. Reudink; "Efficient Spectrum Utilization for Mobile Radio Systems Using Space Diversity;" Mar. 1982; *IEEE Transactions on Communications* vol. COM-30 No. 3.

B. Agee, S. Schell, W. Gardner; "Spectral Self-Coherence Restoral: A New Approach to Blind Adaptive Signal Extraction Using Antenna Arrays"; Apr. 1990; Proceedings of the *IEEE*, vol. 78, No. 4.

W. Gardner; "Exploitation of Spectral Reduncancy in Cyclostationary Signals"; Apr. 1991; *IEEE SP Magazine.*

S. Schell, W. Gardner; "Estimating the Directions of Arrival of Cyclostationary Signals-Pt. 1: Theory and Methods"; Nov. 1991; *IEEE Transactions on Signal Processing.*

S. Schell; "Estimating the Directions of Arrival of Cyclostationary Signals-Pt. II; Performance"; Nov. 1991; *IEEE Transactions on Signal Processing.*

W. Gardner, C. K. Chen; "Signal-Selective Time-Difference of Arrival Estimation for Passive Location of Man-Made Signal Sources in Highly Corruptive Environments, Pt. I: Theory and Method"; May, 1992; *IEEE Transactions on Signal Processing* vol. 40, No. 5.

R. Vaughan; "On Optimum Combining at the Mobile"; Nov. 1988; *IEEE Transactions on Vehicular Technology* vol. 37, No. 4.

Chih-Kang Chen, W. Gardner; "Signal-Selective Time-Difference-of-Arrival Estimation for Passive Location of Man-Made Signal Sources in Highly Corruptive Environments, Pt. II: Algorithms and Performance"; May 1992; *IEEE Transactions on Signal Processing,* col. 40, No. 5.

(List continued on next page.)

*Primary Examiner*—David C. Cain

*Attorney, Agent, or Firm*—John P. O'Banion

[57] ABSTRACT

A method and apparatus for spatial multiplexing of spectrally overlapping communications signals which does not require use of a training signal, computationally intensive direction-finding methods, or antenna calibration is presented. An adaptive antenna array at a base station is used in conjunction with signal processing through self coherence restoral to separate the temporally and spectrally overlapping signals of users that arrive from different specific locations within the locale and to mitigate multipath fading and shadowing at the base station and, by reciprocity, to transmit directively to minimize interfering signals arriving at the mobile (or portable or stationary) units and to mitigate multipath fading and shadowing at the mobile units. The radiation pattern of transmitted signal is matched to the adapted reception pattern of the signal received at the base station.

21 Claims, 10 Drawing Sheets

OTHER PUBLICATIONS

W. Gardner, C. Spooner; "Signal Interception: Performance Advantages of Cyclic-Feature Detectors"; Jan. 1992; *IEEE Transactions on Communications* vol. 40, No. 4.

W. Gardner, W. Brown; "Frequency-Shift Filtering Theory for Adaptive Co-Channel Interference Removal"; Oct. 1989; 23rd Asilomar Conference on Signals, Systems, and Computers vol. 2 of 2.

W. Gardner, S. Venkataraman: "Performance of Optimum and Adaptive Frequency-Shift Filters for Co-channel Interference and Fading"; Nov. 1990; 24th *Annual Asilomar Conference on Signals, Systems and Computers.*

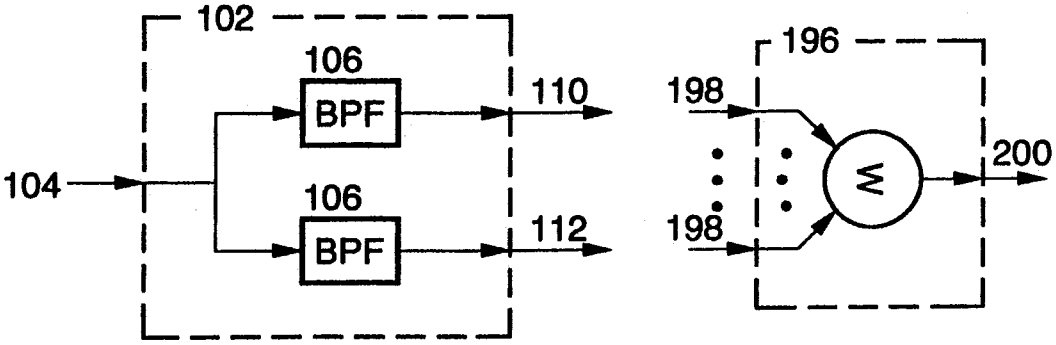
FIG.-10
FIG.-11
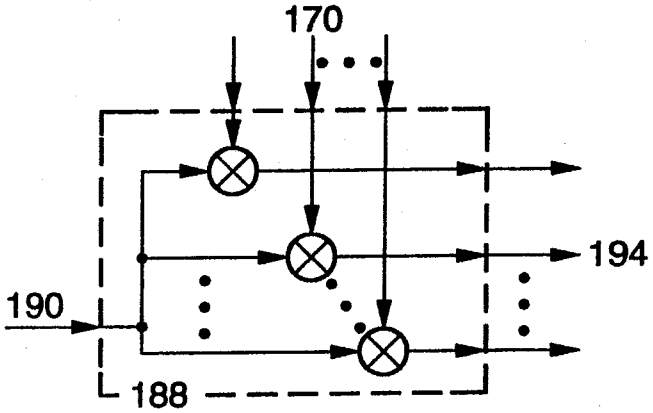
FIG.-12
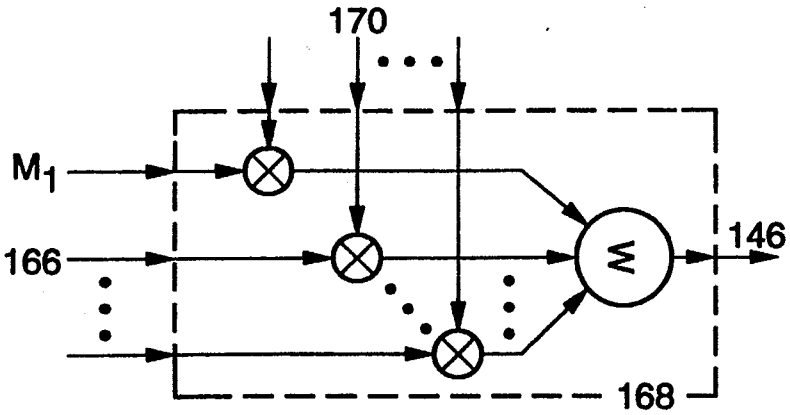
FIG.-13
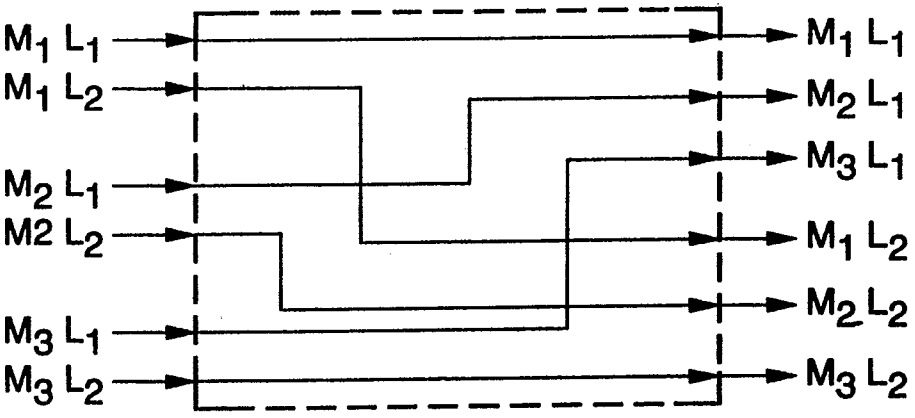
FIG.-14

METHOD AND APPARATUS FOR MULTIPLEXING COMMUNICATIONS SIGNALS THROUGH BLIND ADAPTIVE SPATIAL FILTERING

BACKGROUND OF THE INVENTION

The Government has rights in this invention pursuant to Grant No. MIP-88-12902 awarded by the National Science Foundation.

FIELD OF THE INVENTION

This invention pertains generally to multiplexing radio communications signals, and more particularly to increasing spectral capacity by blind adaptive spatial filtering of spectrally overlapping signals.

DESCRIPTION OF THE BACKGROUND ART

Demand for mobile, portable and stationary personal communication continues to increase as these communication modes become easier to use and more widely available, as they offer a greater variety of services, and as their benefits become more visible. As a result of the increasing demand for a limited number of radio spectrum allocations, new multiplexing techniques that will increase spectral efficiency over conventional multiplexing techniques have been widely sought.

Conventional multiplexing techniques rely solely on frequency, time, or code division to allow multiple users in the same locale to communicate simultaneously with the base station in that locale. These techniques include frequency division multiplexing (FDM)—also called frequency division multiple access (FDMA); time division multiplexing (TDM)—also called time division multiple access (TDMA); and code division multiplexing (CDM)—also called code division multiple access (CDMA).

For FDM, each user's signals occupy separate frequency bands (one for transmit and one for receive) and no other user is assigned to those bands. FDM alone offers very restricted opportunities for increasing spectral efficiency, namely different spectrally efficient modulation schemes, but the potential of such schemes is limited by the severity of the radio communications environment and, even in the most benign environment, the maximum capacity is relatively low.

For TDM, all users occupy the same frequency band, and each is allocated a time slot within which transmission and reception can occur. The frequency bandwidth of each user's signal can be much greater than that in FDM, but a synchronized access scheme is needed to prevent multiple users' signals from being active simultaneously. TDM alone offers no increase in spectral efficiency and requires a complicated access protocol. The inactivity time in typical speech is already exploited in many speech compression methods, so this redundancy has already been used up.

For CDM (using direct-sequence spread spectrum signals), all users' signals occupy the same band and can be active simultaneously. Each user is assigned a unique spreading code which is used at the receiver to separate a desired user's signal from the rest. CDM offers some limited increases in spectral efficiency but requires power control methods that can be difficult to implement in severe fading environments. There can also be some burden in managing the distinct codes that are assigned to the users.

As a result, space division multiplexing (SDM)—also called space division multiple access (SDMA)—was developed to employ spatial filtering to separate spectrally overlapping signals from different users. For SDM, a system can separate a desired user's signal from the rest if its spatial characteristics (e.g., direction of arrival) are sufficiently different from those of the other users. SDM can multiply spectral efficiency by a factor equal to the number of spatially separable channels sharing a spectral band. Since this number can be roughly equal to the number of elements in the antenna array (which can practically be on the order of 100 depending on physical and/or cost limitations at the base station), potentially large increases in spectral efficiency are possible. Transmission power can be reduced, thereby reducing the interference level for other users and increasing mobile (or portable) battery life. Also, reduction or elimination of multipath fading can improve the received signal quality. However, except for variations of these techniques that use fixed multibeam or multisector antennas to further increase capacity, none of them fully exploits the multiplicity of spatial channels that arises because each user occupies a unique spatial location. SDM techniques adapt the antenna array either by estimating the directions of arrival of the spectrally overlapping signals and then using these estimates to compute appropriate weights for the spatial filter, or by minimizing the time-averaged squared error between a known training signal and the output of the spatial filter.

Several methods for adaptively adjusting spatial filters based on antenna arrays have been heretofore developed.

For example, in the "known reference signal" approach, a reference signal is transmitted in addition to the message signal. As a result, channel capacity for the message is reduced, especially as the severity of the environment increases the need for adaptation and as the number of elements in the antenna array is increased. When TDM of reference and message signal is used, receiver complexity is increased, some start-up overhead is incurred in assigning training codes, and signal bandwidth must be increased to compensate for reduced message capacity.

With the "time redundancy" approach, each user has a unique message block length (which is an extra complication), and a given block is transmitted twice (which reduces effective capacity by 50 percent).

With the "frequency redundancy" approach, the message is transmitted at two different carrier frequencies, which reduces effective capacity by 50 percent.

With the "DF-based beamforming" approach, for moderately to widely separated multipath reflections, and for a large number of sources in a frequency band (which is desirable for increased spectral efficiency), direction-finding (DF) based methods are impractical or unusable and incur prohibitive computational expense. Array calibration problems also arise.

It can be seen therefore, that SDM versions based on direction estimation have numerous disadvantages, including computationally intensive algorithms, poor performance in the presence of multipath signals arriving from different directions, the need to measure, store, and update array calibration data, and considerable sensitivity to errors in the array calibration data. Versions that require a training signal have different disadvantages, including the need to use spectral capacity to periodically transmit the training signal, the need to synchronize the received and locally generated copies of the training signal, and the need to adaptively increase or decrease the duration of the training signal to accommodate varying levels of interference.

Therefore, there is a need for a spatial filtering method of multiplexing communications signals which overcomes the foregoing deficiencies. The present invention fulfills that need.

SUMMARY OF THE INVENTION

The present invention pertains generally to spatial filtering techniques, and more specifically to adaptive space, time and frequency multiplexing. This multiplexing method is neither dependent on direction of arrival estimation nor on use of a reference or training signal.

By way of example and not of limitation, an adaptive antenna array at a base station separates temporally and spectrally overlapping received signals of different users and transmits directively to each user, exploiting multipath when present. The invention uses the technique of restoring the spectral coherence of a received signal of interest impinging on an array of antennas in order to adapt the spatial filter for reception at the base station and determine the optimum reception pattern for the signal, which filter can be reused for transmission with a radiation pattern equal to that of the adapted reception pattern. Unlike schemes that rely solely on frequency, time, or code division multiplexing and thus use only one spatial channel, the present invention exploits space as well as partial time and frequency division multiplexing (STFDMA) and thus uses multiple spatial, temporal, and spectral channels. Users whose signals arriving at the base station are spatially separable are assigned to spectral bands that overlap, and users whose signals arriving at the base station are spatially inseparable are assigned to disjoint spectral bands. Also, signals coming from the individual users can be assigned to time intervals that are interleaved with those assigned to signals coming from the base station. Under the assumption that users are sufficiently well distributed throughout a geographical area, all available spatial and spectral channels can be used effectively. Since the number of multiple spatial channels that can be separated from each other by the antenna array is approximately equal to the number of antenna elements in the array (which can be quite large), overall capacity can be much greater than schemes using a single spatial channel. Also, unlike adaptive array schemes that require direction estimation processors or known training signals, the present invention uses a property restoral method to exploit some property, such as the spectral redundancy (cyclostationarity or spectral correlation or spectral coherence), that is already present in essentially all digital communication signals and thus does not require array calibration data or computationally intensive multidimensional searches for direction finding (DF). Nor does it waste channel capacity by transmitting a training signal.

An object of the invention is to increase the communications capacity of limited spectral allocations.

Another object of the invention is to provide for overlapping spectral channels without unacceptable interference between users.

Another object of the invention is to spatially filter communications signals without the need for a training signal.

Another object of the invention is to spatially filter communications signals without the need to determine direction of arrival.

Another object of the invention is to blindly adapt an antenna array.

Another object of the invention is to mitigate multipath fading and shadowing of received signals.

Another object of the invention is to directively transmit signals to users from a base station without employing direction finding techniques.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only:

FIG. 10 is a schematic block diagram of one embodiment of a splitter element shown in FIG. 6 and FIG. 7.

FIG. 11 is a schematic block diagram of one embodiment of an input summer element shown in FIG. 8.

FIG. 12 is a schematic block diagram of one embodiment of a vector scalar multiplier element shown in FIG. 8.

FIG. 13 is a schematic block diagram of one embodiment of an inner product element shown in FIG. 8.

FIG. 14 is a partial schematic diagram showing the typical configuration of a signal router element shown in FIG. 8.

DESCRIPTION OF THE PREFERRED EMBODIMENTS

Figure 1:
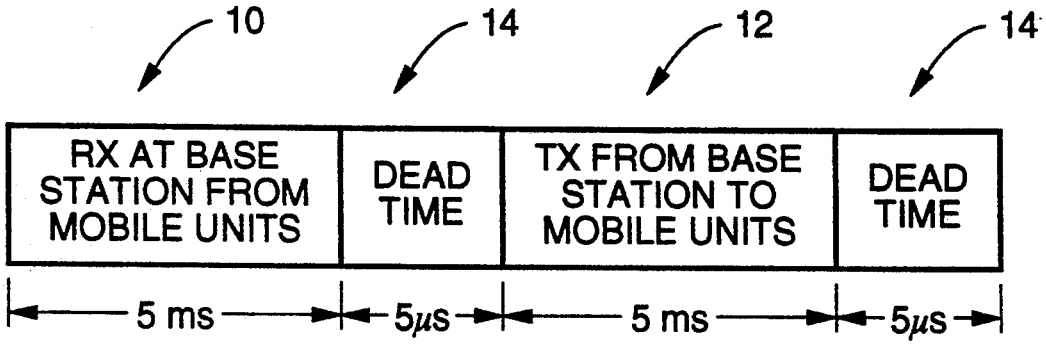
FIG. 1 diagrammatically shows the typical time multiplexing windows employed in the present invention.

Referring more specifically to the drawings, for illustrative purposes the present invention is embodied in the drawings of FIG. 1 through FIG. 16. It will be appreciated that the method of the present invention may vary as to specific steps and their order of implementation, and that the apparatus of the present invention may vary as to configuration and as to details of the parts without departing from the basic concepts as disclosed herein.

The conventional transmit/receive configuration for multiuser cellular communication consists of a base station through which all users in a given cell communicate. The base station then communicates with other base stations and with a central switching office to provide cell-to-cell communication and cell-to-wire-line communication, respectively, for the individual users. Communication among base stations is not, in the usual sense, multiuser communication and, therefore, is not presented herein.

Communication between individual users in a cell and the base station in that cell can, in principle, exploit SDMA by performing adaptive spatial filtering at either each user's location or the base station or both. However, adaptive arrays at the mobile unit (or the portable or stationary personal unit) are prohibitively expensive and subject to neglect or abuse by the users. Also, adaptive spatial filtering at the mobile unit is unlikely to be effective since the signals from the base station and the other interferers can arrive from a nearly uniform angular spread over 360 degrees (due to scattering, for example, from buildings, other cars, and the ground in the mobile communication environment). Therefore, in the present invention the existing single omnidirectional antenna at the mobile unit is retained, but a multi-element antenna array is used at the base station.

Spatial filtering as disclosed herein requires the use of a multi-element antenna array with a large number of elements. Therefore spatial adaptation occurs only during the transmission from the mobile unit to the base station; transmission from the base station to the mobile unit must use a spatial filter that is developed during said adaptation. In addition, the spatial filtering method of the present invention is frequency dependent and, therefore, both directions of transmission must use the same carrier frequency. In order to use the same frequency for duplex communications, the present invention also employs time division multiplexing of the signals from the base station and the users. That is, reception at the base station from all mobile units is temporally separated from transmission from the base station to all mobile units. The base station transmits to the user unit for some time period T, the user then transmits to the base station for time period T, and the cycle repeats.

Therefore, spatial filtering at the base station separates spectrally and temporally overlapping signals of multiple users during transmission from and reception at the base station. The lack of direct spatial filtering at the mobile unit does not imply, however, that mobile units must be prevented from interfering with each other, because the TDM scheme employed by the present invention insures that all mobile units transmit at the same time during one time period, and that they all receive at the same time in another time period.

During the time period that the signals are received by the base station, the base station blindly adapts its antenna array using the spectral coherence restoral (SCORE) method of the present invention. With SCORE, spectral redundancy already present in the signal is exploited and the weights of spatial filters are computed while the received data is saved.

To understand use of the SCORE method for blindly adapting an antenna array, let the vector x(n) denote the sampled complex envelopes of the output signals of M antennas having an arbitrary geometric arrangement and arbitrary directional characteristics (but preferably omnidirectional). To maximize spatial resolution while preventing grating lobes (ambiguities), the antennas are typically separated by approximately one half of the wavelength corresponding to the highest frequency in the reception band. It should be noted that this geometry is fundamentally different from that used in most space diversity systems, in which antennas are spaced many wavelengths apart so as to decorrelate multipath propagation parameters at the different antennas. Also, let $y(n) \triangleq w^H x(n)$ be the output of the spatial filter, where w is referred to as the weight vector representing a set of weights that realize the reception pattern of the signal of interest as it impinges on the array of antennas and which are used to extract the signal of interest. By choosing w appropriately, an adaptive receiver can enhance (steer beams in the direction of) desired signals, attenuate (steer nulls in the direction of) undesired signals, and minimize the contribution of additive noise (through coherent processing gain and by minimizing the height of sidelobes in the antenna pattern). In general, the sum of the number of beams and the number of nulls that can be controlled is equal to one less than the number M of antenna elements.

Instead of choosing w to maximize the degree of correlation between y(n) and a known training signal as is typically done in conventional schemes, the SCORE method chooses w and an auxiliary spatial filter c to maximize the degree of correlation (correlation coefficient) between y(n) and an auxiliary output signal $u(n) \triangleq c^H x(n-\tau)^* e^{j2\pi\alpha n}$:

$$\max_{w,c} \frac{|R_{yu}|^2}{R_{yy}R_{uu}} \rightarrow \max_{w,c} \frac{|w^H R^{\alpha}_{xx^*}(\tau)c|^2}{[w^H R_{xx} w]\,[c^H R_{x^*x^*} c]} \tag{1}$$

Since $R_{yu}$ is the cyclic cross-correlation between the spatial filter output $w^H x(n) = y(n)$ and the conjugated auxiliary spatial filter output $c^H x^*(n-\tau)$, then the quantity being maximized in equation (1) is a measure of the degree of conjugate spectral coherence between these two spatial-filter outputs. Since the presence of interfering signals and noise that corrupt the signal of interest in x(n) decreases the degree of conjugate spectral coherence by increasing the denominator in equation (1) relative to the degree exhibited by the uncorrupted signal of interest, then spatial filtering with w and c to maximize the correlation coefficient as in equation (1) can be interpreted as restoring conjugate spectral coherence. Thus, the criterion in equation (1) is referred to as spectral coherence restoral (SCORE). Also, since $R_{yu}$ can be interpreted as the Fourier coefficient for the regenerated sine wave at frequency $\alpha$ in the product waveform $[w^H x(n)][c^H x^*(n-\tau)]$, then the SCORE method can be seen to maximize the average power of this sine wave relative to the average powers of the waveforms $w^H x(n)$ and $c^H x^*(n-\tau)$. Under the assumption that $L_\alpha$ signals have cycle frequency $\alpha$, it can be shown that the solutions to the equation in (1) are given by the $L_\alpha$ most dominant eigenvectors $w_l$, for $l=1,\ldots,L_\alpha$ that satisfy $$R_{xx^*}^{\alpha}(\tau) R_{x^*x^*}^{-1} R_{xx^*}^{\alpha H}(\tau) w_l = \lambda_l R_{xx} w_l \tag{2}$$

and similarly for c.

It should be noted that only the most dominant eigenvector of equation (2) is needed when only one signal exhibits cyclic conjugate correlation at the chosen value of $\alpha$, in which case the matrix product on the left-hand side of equation (2) has rank equal to one, and thus this eigenvector can be found using a simple iteration based on the power method of computation. In the present invention, this is true in the absence of multipath reflections of the desired signal. In the presence of K spatially separable multipath reflections of the desired signal, each of the K+1 most dominant eigenvectors extracts a linear combination of the multipath reflections; thus, the most dominant eigenvector can still be used to extract the desired signal, although an adaptive equalizer might be required to mitigate the smearing of the signal in time if the delay spread of the multipath is too great.

Alternatively, note that the desired signals (those having cycle frequency $\alpha$) are the only ones common to both $x(n)$ and $x(n-\tau)^* e^{j2\pi\alpha n}$ in the sense that the correlation between these two data sets is asymptotically equal to the correlation between the components due to the desired signals and their frequency-shifted and conjugated versions. From this point of view, estimating the desired signals is equivalent to estimating the common factors of the two data sets $x(n)$ and $x(n-\tau)^* e^{j2\pi\alpha n}$. Common factor analysis (also called canonical correlation analysis) is a well-known technique in multivariate analysis. Formulating the problem in this way leads to exactly the same solution of equation (2). The SCORE method can also estimate the desired signals that are common to both $x(n)$ and $x(n-\tau)e^{j2\pi\alpha n}$, in which case the conjugation symbols * are dropped from equation (2), although this variation is not required in the present invention.

It should be noted that the SCORE method is based upon the cyclostationarity exhibited by a signal. A vector-valued complex envelope $x(n)$ exhibits cyclostationarity if it is correlated with either a frequency-shifted version of itself (i.e., if it exhibits spectral coherence) for any nonzero frequency shift $\alpha$ or a conjugated and frequency-shifted version of itself for any frequency shift $\alpha$. Mathematically, this correlation (or spectral coherence) is expressed in terms of the cyclic autocorrelation matrix $$R_{xx}^{\alpha}(\tau) \tag{3}$$

or the cyclic conjugate correlation matrix $$R_{xx^*}^{\alpha}(\tau) \tag{4}$$

respectively, where $$R_{xx}^{\alpha}(\tau) \triangleq [x(n)x(n-\tau)^H e^{-j2\pi\alpha n}]_{\infty} \tag{5}$$

$$R_{xx^*}^{\alpha}(\tau) \triangleq [x(n)x(n-\tau)^T e^{-j2\pi\alpha n}]_{\infty} \tag{6}$$

with $$\langle f(n)\rangle_N \triangleq \frac{1}{N}\sum_{n=0}^{N-1} f(n) \tag{7}$$

and where $(\cdot)^T$ and $(\cdot)^H$ denote the matrix transposition and matrix conjugate transposition operators, respectively. The values of $\alpha$ for which either of these correlation matrices are nonzero are the cycle frequencies of the signals comprising $x(n)$. Since equations (3) and (4) can be reinterpreted as the Fourier coefficients for the matrices of conjugate and nonconjugate lag-product waveforms $x(n)x(n-\tau)^H$ and $x(n)x(n-\tau)^T$, then it can be seen that $x(n)$ exhibits cyclostationarity (or spectral coherence) if and only if the lag-product waveforms contain finite-strength additive sine-wave components with frequency equal to the cycle frequency $\alpha$. That is, cyclostationarity means that sine waves can be generated by multiplying the signal by a delayed and possibly conjugated version of itself. Most digital communication signals exhibit cyclostationarity as a result of the periodic sampling, gating, keying, and mixing operations in the modulator. For example, the cycle frequencies of binary phase shift keying (BPSK) are equal to the doubled carrier frequency offset, harmonics of the baud rate, and sums and differences of these. More specifically, if $x(n)$ contains a BPSK signal having carrier offset $f_c$ (relative to the frequency of the downconverter) and baud rate $f_b$, then $R_{xx}^{\alpha}(\tau)$ is not identically zero for $\alpha = kf_b$ for integers k, and $R_{xx^*}^{\alpha}(\tau)$ is not identically zero for $\alpha = 2f_c + kf_b$ for integers k. The useful values of $\tau$ in the correlation matrices are typically between 0 and $\frac{1}{2}f_b$. The only case of particular interest in the present invention is the fact that for a scalar BPSK signal having carrier frequency offset $f_c$, the magnitude of the cyclic conjugate correlation $R_{xx^*}^{2f_c}(\tau)$ is maximized at $\tau=0$ regardless of the pulse shape. Measurements of these two types of cyclic correlations are useful because they select contributions from only the signal components that exhibit the specified cyclostationarity property and discriminate against all others. This is analogous to the property that measurements of the correlation between a desired signal corrupted by additive interference and noise and an uncorrupted version of the desired signal (e.g., the training signal) select only the contributions from the desired signal and discriminate against all others. The utility of exploiting cyclostationarity to gain signal-selectivity has been demonstrated for many applications, including adaptation of antenna arrays, estimation of directions of arrival, estimation of time difference of arrival, detection, and the like.

Referring to FIG. 1, during the receiving and adaptation phase 10, the weights of the spatial filters are computed. At the end of that phase, the weights are applied to the received data to separate the signals sent by the mobile units. During the transmission phase 12, the weights computed in the receiving phase 10 are used to direct the transmission of each outgoing signal to the appropriate mobile unit. The duration of the phases is limited here primarily by the reciprocal of the fast fading rate (the maximum rate is approximately 100 fades/-second, so the duration of each phase can be about half the reciprocal, or 5 milliseconds) because the propagation conditions must remain relatively constant over this time for the spatial filtering to be effective. A "dead time" 14 during which neither reception nor transmission occurs is inserted between each phase to allow the trailing edges of the signal from or to the farthest mobile unit to arrive at their destination and to allow the microwave hardware at the base station and the mobile unit to switch between transmission and reception modes (since the same spectral band is used for both). This dead time is negligible (approximately 5 microseconds in a cell having radius of 1 mile) compared to the reception and transmission times (approximately 5 milliseconds). The cycle summarized in FIG. 1 is then repeated.

To avoid the waste of channel capacity and additional synchronization difficulties that occur when a training signal is used to adapt the array, the SCORE method of blind adaption is used to separate signals based on their differing carrier frequencies. Thus, the SCORE method represented by equation (2) is implemented for each active user in the cell. Although it is conceivable that differing baud rates could also be used to separate signals, the additional complexity of accommodating a unique baud rate for each user is prohibitive.

Figure 2:
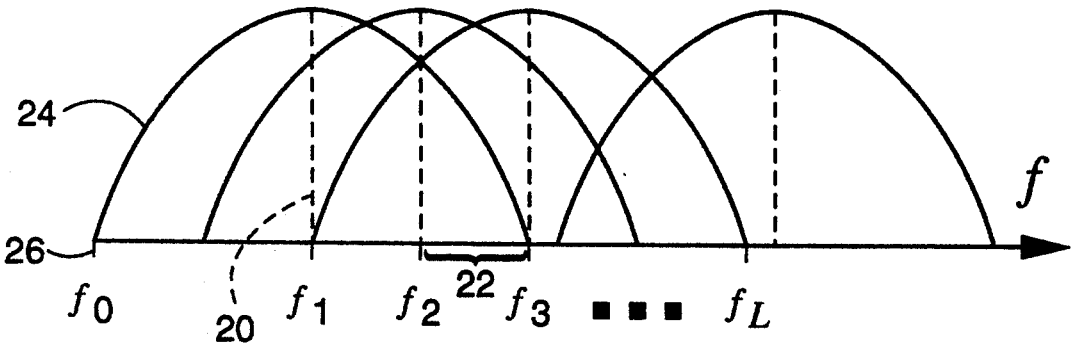
FIG. 2 diagrammatically shows the partial frequency division multiplexing employed in the present invention.

Consequently, as can be seen in FIG. 2, each mobile unit is assigned a unique carrier frequency (accomplished during call initiation and hookup) according to the relationship $$f_l = f_0 + (l)(f_{sep}) \text{ for } l = 1, \ldots, L \quad (8)$$

where $f_l$ is the carrier frequency 20 of the user numbered 1, $f_0$ is the lowest frequency 26 in the reception band, $f_{sep}$ is the separation 22 between adjacent carrier frequencies, and L is the maximum number of users that can be accommodated in the cell. The choice of $f_{sep}$ is determined by the maximum Doppler shift (about 100 Hertz in the land mobile cellular radio environment), and by some convergence-time considerations in the SCORE method, namely the time required for an estimate of a cyclic conjugate correlation to adequately reject contributions from signals having adjacent carrier frequencies (at least 100 Hertz separation is required for adequate rejection in the 5 milliseconds during which adaptation occurs; this follows because the cycle resolution of the measurement of the cyclic conjugate correlation matrix, and thus the minimum separation of the doubled carriers, is equal to the reciprocal of the averaging time). The value of $f_{sep}$ is also limited by the maximum number of spectrally overlapping signals 24 that can be separated by the antenna array. Because transmission from the base station to each mobile unit is highly directional, a smaller frequency reuse distance, such as three, can be tolerated in the present invention than in the conventional analog frequency modulation (FM) scheme in which it is seven. The success of the SCORE-STFDMA method depends on the ability to use spatial filters to spatially separate spectrally overlapping signals and the ability to use conventional spectral filters to separate spatially inseparable signals. This frequency allocation method coupled with the use of the SCORE method accomplishes this under the assumption that spatially inseparable users can be assigned to disjoint spectral bands. One approach to accomplish this is to obtain and use knowledge of the directions of arrival of the signals from the mobile units. This in turn can be accomplished either by using a location sensing device (e.g., global positioning system) in each mobile unit, which could be prohibitively expensive, or by using the signal-selective Cyclic MUSIC or Cyclic Least Squares (CLS) direction estimation methods at the base station, or by using the signal-selective Cyclic Cross Correlation (CCC) time-difference-of-arrival (TDOA) estimation algorithm at the base station and one or two auxiliary reception sites within the cell.

In the Cyclic MUSIC approach, we measure $$R_{xx^*}^{\alpha}(\tau) = \langle x(n)x(n-\tau)^T e^{-j2\pi\alpha n} \rangle_N$$

where $\alpha$ equals twice the carrier frequency of the desired user. We then compute the singular value decomposition $$R_{xx^*}^{\alpha}(\tau) = U\Sigma V^H$$

of $R_{xx^*}^{\alpha}(\tau)$ where U and V are $M \times M$ unitary matrices and $\Sigma$ is diagonal with elements $\sigma_1, \ldots, \sigma_M$ arranged in descending order $\sigma_1 \geqq \ldots \geqq \sigma_M \geqq 0$. Then, we search for the highest peak in the function $$P(\theta) = |U_1^H a(\theta)|$$

where the corresponding value of $\theta$ is the estimated direction of arrival of the desired user, $U_1$ is the first column of U, and $a(\theta)$ is the array response vector for angle $\theta$ and is typically known for many values of $\theta$ equally spaced from 0 degrees to 360 degrees.

In the CLS method, we measure $$R_{xx^*}^{\alpha}(\tau) = \langle x(n)x(n-\tau)^T e^{-j2\pi\alpha n} \rangle_N$$

where $\alpha$ equals twice the carrier frequency of the desired user. We also measure $R_{x^*x^*}(\tau) = \langle x(n)^* x(n)^T \rangle_N$ and compute $$R = R_{xx^*}^{\alpha}(\tau) R_{x^*x^*}^{-1} R_{xx^*}^{\alpha}(\tau)^H$$

and search for the highest peak in the function $P(\theta) = a(\theta)^H R a(\theta)$. The corresponding value of $\theta$ is the estimated direction of arrival of the desired user.

The Cyclic MUSIC and CLS approaches, however, require the use of a calibrated array, but this array can be much smaller (e.g., only 4 elements) than the one used for spatial filtering because a unique carrier frequency is assigned to each mobile unit and these methods are signal selective.

In the CCC method of TDOA estimation, we compute a cross conjugate cyclic spectrum estimate $S_{yz^*}^{\alpha}(f)$ and then minimize the weighted inverse Discrete Fourier Transform (DFT)

$$\sum_f S_{yz^*}^{\alpha}(f) |P(f)|^2 e^{j2\pi fd}$$

with respect to the TDOA estimate d, where P(f) is the raised-cosine pulse-transform used in the BPSK signal. Multipath propagation will result in multiple peaks. One of several possible methods for estimating the cross conjugate cyclic spectrum is to frequency smooth the cross conjugate cyclic periodogram $$\sum_f W(f) Y(\alpha/2 + f) Z(\alpha/2 - f)$$

Where Y and Z are the DFT's of the signals received at main and auxiliary stations and W(f) is a smoothing window.

To actually locate a user would require intersection of the two location-hyperbolas determined by two such TDOA estimates obtained from two pairs of reception stations, each pair of which includes the same base station and a unique auxiliary reception site. However, a single TDOA estimate for a set of estimates corresponding to multipath propagation from a single pair of reception stations could be adequate for determining spatial separability.

Also, it is possible to forego the task of locating mobile units and to assign frequencies in the least active bands (or at random) and make reassignments whenever co-channel interference is detected after the spatial filter has converged. This detection can possibly be accomplished using the SCORE method or, alternatively, can be readily detected by the user at the mobile unit and reported (by the push of a button) to the base station.

Although there is some flexibility in the choice of a modulation type, the type chosen for the present invention for several reasons is BPSK using Nyquist-shaped pulses having 100% excess bandwidth. The strength of the cyclic conjugate correlation $R_{xx^{*2/c}}$ for a BPSK signal having carrier offset $f_c$ is the same as the strength of the signal itself, which speeds convergence of the SCORE adaptation method. Although BPSK having 100% excess bandwidth is not as spectrally efficient as modulation types using less excess bandwidth and/or higher-order alphabets, it is less susceptible to noise, easier to synchronize to, and its 200% spectral redundancy (100% due to double sideband and 100% due to excess bandwidth) can be effectively exploited for equalization and reduction of residual co-channel interference. Since the cyclic conjugate correlation characteristics of differential phase shift keying (DPSK) are identical to those of BPSK, DPSK can be used for transmission from the base station so as to simplify the receiver in the mobile unit. The actual baud rate and thus the bandwidth of the BPSK signal depend on the rate of the vocoder used. In the present invention, a vocoder rate of 8 kilobaud/second is used. Since transmission and reception are multiplexed in time, the actual rate that must be supported by the channel is 16 kilobaud/second, which yields a BPSK bandwidth of 32 Khz. In general, for a total system-bandwidth $B_t$, single-user channel-bandwidth $B_c$, and frequency-reuse factor r, the maximum number L of users that can be accommodated by the frequency allocation scheme in equation (8) is $L=(B_t/r-B_c)/f_{sep}+1$. The number M of antenna elements required to separate these signals is bounded from below by the number K of users whose signals are spectrally overlapping with any given user's signal, where $M>K=2(B_c/f_{sep}-1)$. Using $B_c=32$ Khz and $f_{sep}=1$ Khz, at least 63 antenna elements (which can be omnidirectional) are needed to separate the signals of all users, assuming that the energy from each user arrives at the base station from a single direction, and assuming that the users are approximately uniformly distributed throughout the cell. In practice, more antenna elements might be required to achieve adequate performance at full capacity in the presence of spatially separable multipath, although fewer antenna elements can suffice if a lower capacity is opted for and appropriate channel allocation is done. Also, adaptive equalization should follow the spatial filtering to mitigate the time-smearing effects of multipath.

Figure 3:
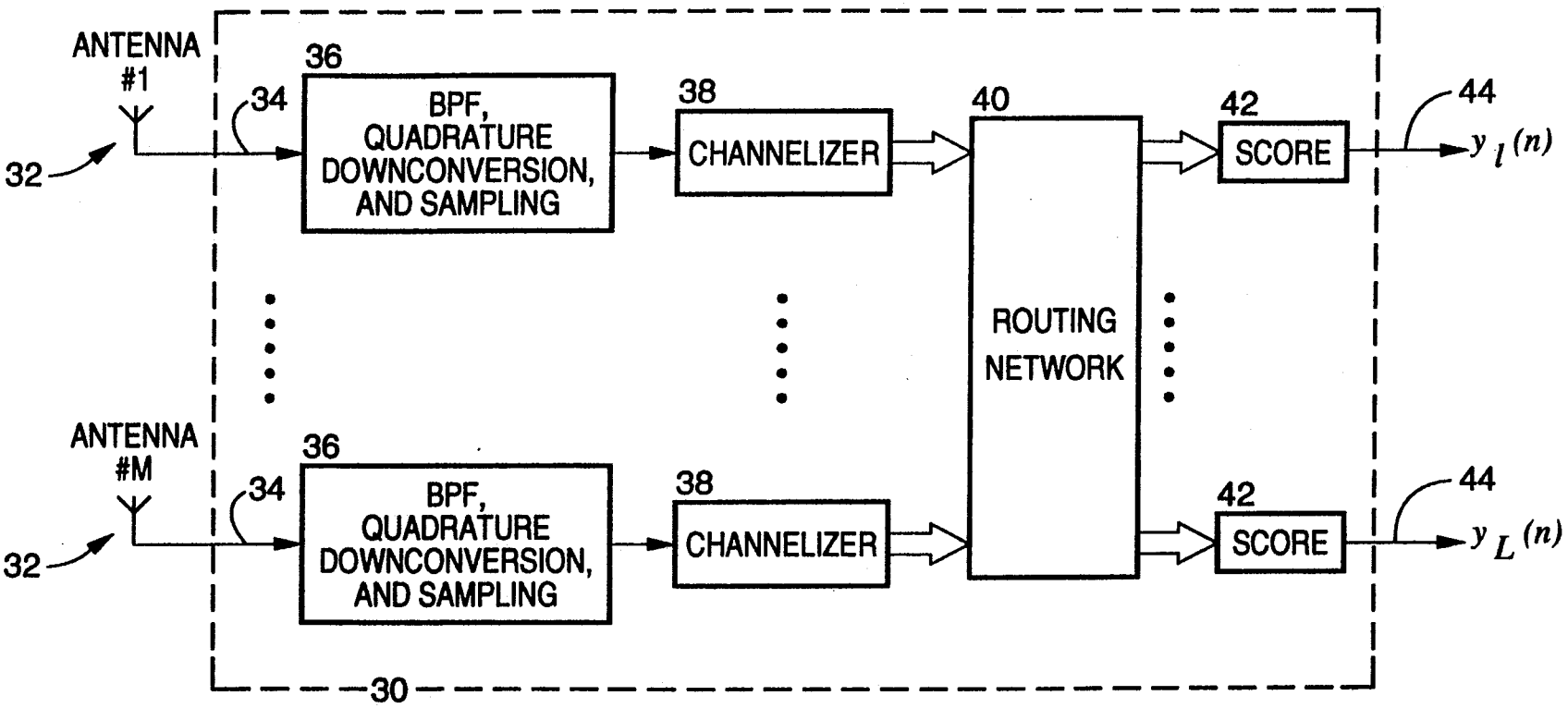
FIG. 3 is a functional block diagram showing a generalized receiver employing the present invention.

A block diagram of a generalized receiver 30 at the base station is shown in FIG. 3. The output signals 34 of the M antenna elements 32 are processed by individual preprocessing systems 36 that perform bandpass filtering, quadrature downconversion, sampling, and channelization on each output signal at each antenna. Channelizers 38 transform the resultant scalar input signal to a $L\times1$ vector of signals, each of which is obtained by bandpass filtering (centered on a particular user's carrier frequency and having bandwidth equal to that of this user's signal) the input signal and downconverting it to baseband, where L is the maximum number of users that the system can accommodate. The outputs of the M channelizers 38 then pass through a routing network 40 that routes the M channelizer outputs corresponding to each user to a SCORE processor 42. That is, the M vector inputs each having dimension L and corresponding to a particular antenna element are rearranged to yield L vector outputs each having dimension M and corresponding to a particular user's carrier frequency. An example of a $3\times2$ to $2\times3$ router can be seen in FIG. 14. Each $M\times1$ vector is then processed by a corresponding SCORE processor device 42 to extract the signal of the user that is assigned the corresponding carrier frequency and separate that signal into a usable output signal 44.

Figure 4:
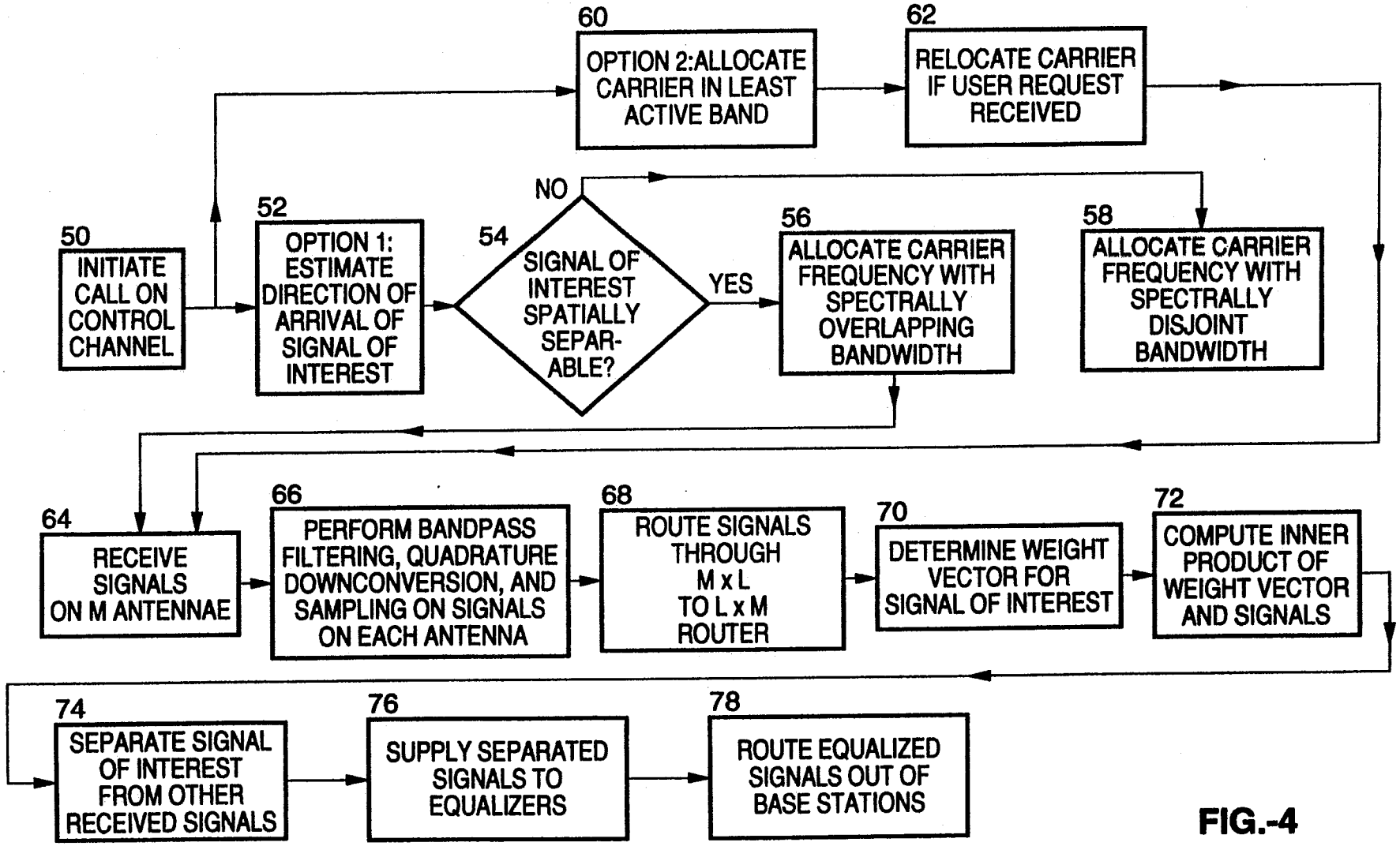
FIG. 4 is a flow diagram showing the general reception steps of the present invention.

Referring now to FIG. 4, a typical implementation of the invention would begin with call initiation on the control channel at step 50. Here a call can be initiated either by the base station or by the user. Call initiation is preferably performed on separate control channels so that communication channels are not wasted. These control channels would typically occupy distinct, non-overlapping spectral bands. If the user initiates the call then the reception cycle can proceed. On the other hand, if the base station initiates the call the user must first respond on the control channel before the reception cycle can proceed.

If direction of arrival information is to be used for frequency allocation, then the reception cycle proceeds with step 52 where an estimation of the direction of arrival of the signal from the user (signal of interest) is made. This option is useful because the signals from users who are not sufficiently separated geographically may not be spatially separable and, therefore, should be allocated disjoint carrier frequencies. At step 54 the determination of spatial separation is made. If the signal of interest is spatially separable from the other users' signals, then at step 56 that user is assigned a carrier frequency which, when modulated, results in a signal having a bandwidth which spectrally overlaps with that of other users, but whose carrier frequency is sufficiently separated from the carrier frequencies of the other users that signal-selective spatial filtering can be performed. If the signal of interest is not spatially separable, then at step 58 the user is assigned a carrier frequency which is sufficiently removed from those of the other users that the signals will not overlap. It should be clarified that the direction of arrival estimation system will not necessarily locate each mobile unit; rather it will determine possible multiple apparent locations for each unit that result from multipath propagation due to reflections and shadowing. But, it is these apparent locations—not the actual location—that are relevant in assessing spatial separability.

Steps 52 through 58 are optional and can be omitted. If carrier frequencies assigned without an initial determination of spatial separability, then the reception cycle would proceed from step 50 to step 60. At step 60, carrier frequencies are allocated in the least active band. If interference between users results, then a reassignment of carrier frequencies can be made at step 62 if requested by the user. As can be seen, therefore, direction of arrival information is neither required nor it is a necessary element of the SCORE-STFDMA method of signal processing.

Once the user is assigned a carrier frequency which may or may not result in spectral overlap of the modulated signal with those of others, communications begins. At step 64, the signal of interest together with interfering signals is received on each antenna in an array of M antennas. At step 66, bandpass filtering, quadrature downconversion, and sampling of the signal of interest and interference occurs for each antenna in the array. Since a particular user's signal will be separated from signals of other users by processing the M output signals of the M bandpass filters that are centered on the particular user's signal, each group of M corresponding bandpass filter outputs is routed to a different SCORE processor ar step 68.

Once the signals of interest and interference are routed, at step 70 the SCORE method of adaption based on restoring spectral coherence is applied to determine the weight vector w. Then, at step 72, the inner product of the weight vector w and the signal of interest and interference is determined. This inner product will be separate and distinct for the signals of all users and, therefore, the signal of interest is separated from those of other users at step 74.

It is important to note that the foregoing steps result in an implicit determination of an optimum reception pattern for the signal of interest as it impinged on the antennas in the array. This reception pattern can have single or multiple beams and multiple nulls determined by multipath reflections from buildings and by locations of interfering users. The present invention uses that reception pattern, as represented by the SCORE weight vector, as the foundation of spatial multiplexing.

Once the signal of interest is separated from those of other users, the signal is equalized at step 76 and routed out of the base station at step 78 where it interfaces directly with the wireline phone network or is passed to another base station for interconnection with the wireline phone network.

Figure 5:
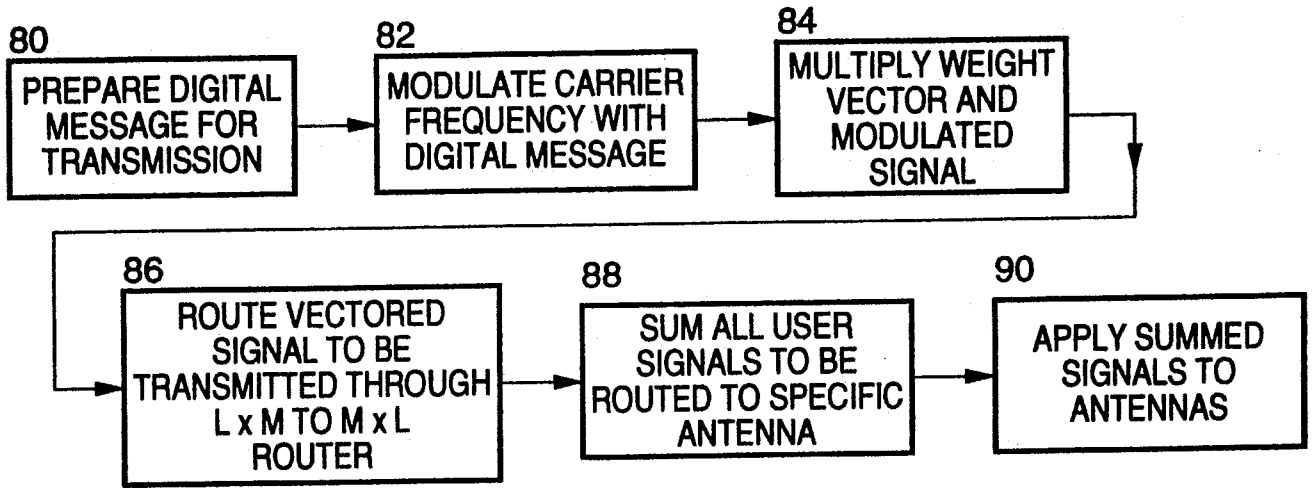
FIG. 5 is a flow diagram showing the general transmission steps of the present invention.

Referring now to FIG. 5, a responsive message from the wireline phone network (which may be routed through the base station directly or through multiple base stations) is digitized for transmission at step 80. The carrier frequency is then modulated with the digital message at step 82. At step 84, the modulated signal is then multiplied by the weight vector w developed in step 70. At step 86, the vectored signal is passed through a L×M to M×L router for routing to a corresponding antenna. At step 88, the signals from all users to be routed to specified antennas are summed. The summed signals are applied to the antennas at step 90.

The overall effect of this process is that the radiation pattern of the signal transmitted by the base station to the user will match the reception pattern of the user's signal as seen by the antenna array at the base station. Therefore, the output signals and phasing of those signals may vary from antenna to antenna in the array.

Figure 6:
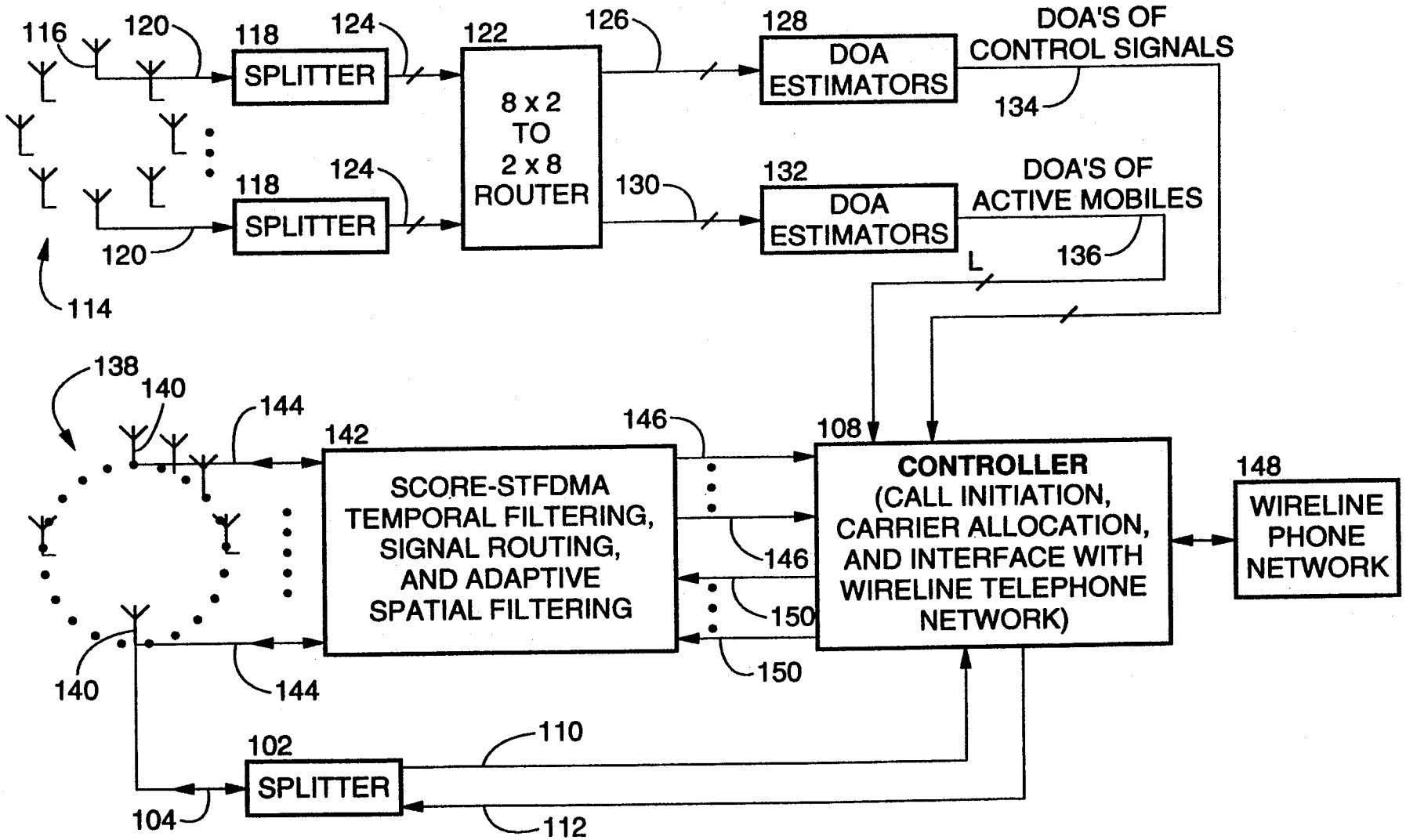
FIG. 6 is a functional block diagram of one embodiment of an overall communications system employing the present invention.

FIG. 6 shows a block diagram of one embodiment of an overall system which implements the steps described above. One of the antennas 140 in the antenna array 138 is coupled to a splitter/combiner 102 through interconnection 104 and is used to transmit and receive on the control channel. Splitter 102, which can be seen in more detail in FIG. 10, includes a pair of bandpass filters 106, the outputs of which are coupled to controller 108 through interconnections 110 and 112, respectively. Splitter 102 is used to separate the spectrally disjoint control signals received from the mobile user and the control signals transmitted to the mobile user, and to separate the control channel from the band occupied by active users. The control channel is used for call initiation and coordination between the user and the base station as previously described.

A calibrated antenna array 114 contains a plurality of antennas 116 (more than 4) which are separately coupled to a plurality of splitters 118 through interconnections 120. Splitters 118 are similar in configuration to splitter 102 previously described and, where eight antennas are used, the outputs of splitters 118 are coupled to an 8×2 to 2×8 router 122 as shown through interconnections 124. Referring also to FIG. 14, a typical router configured for 3×2 to 2×3 can be seen. As previously described, the function of a router is that the M vector inputs each having dimension L and corresponding to a particular antenna element are rearranged to yield L vector outputs each having dimension M and corresponding to a particular user's carrier frequency.

Router 122 permits separation of a set of signals from the eight antennas in antenna array 114, one set representing control signals and the other representing user signals. Control output 126 is coupled to control direction of arrival (DOA) estimator 128, and user output 130 is coupled to user DOA estimator 132. The DOA data corresponding to the control signals is coupled to controller 108 through interconnections 134, while similar data corresponding to users is coupled to controller 108 through bus 136. Controller 108, which can be a microcomputer or the like, performs the functions of call initiation, carrier allocation, and interfacing with the telephone network 148.

Optionally, elements 114 through 136 which comprise the apparatus needed to estimate directions of arrival can be omitted or replaced by other elements appropriate to the implementation of a TDOA estimator such as CCC.

Figure 7:
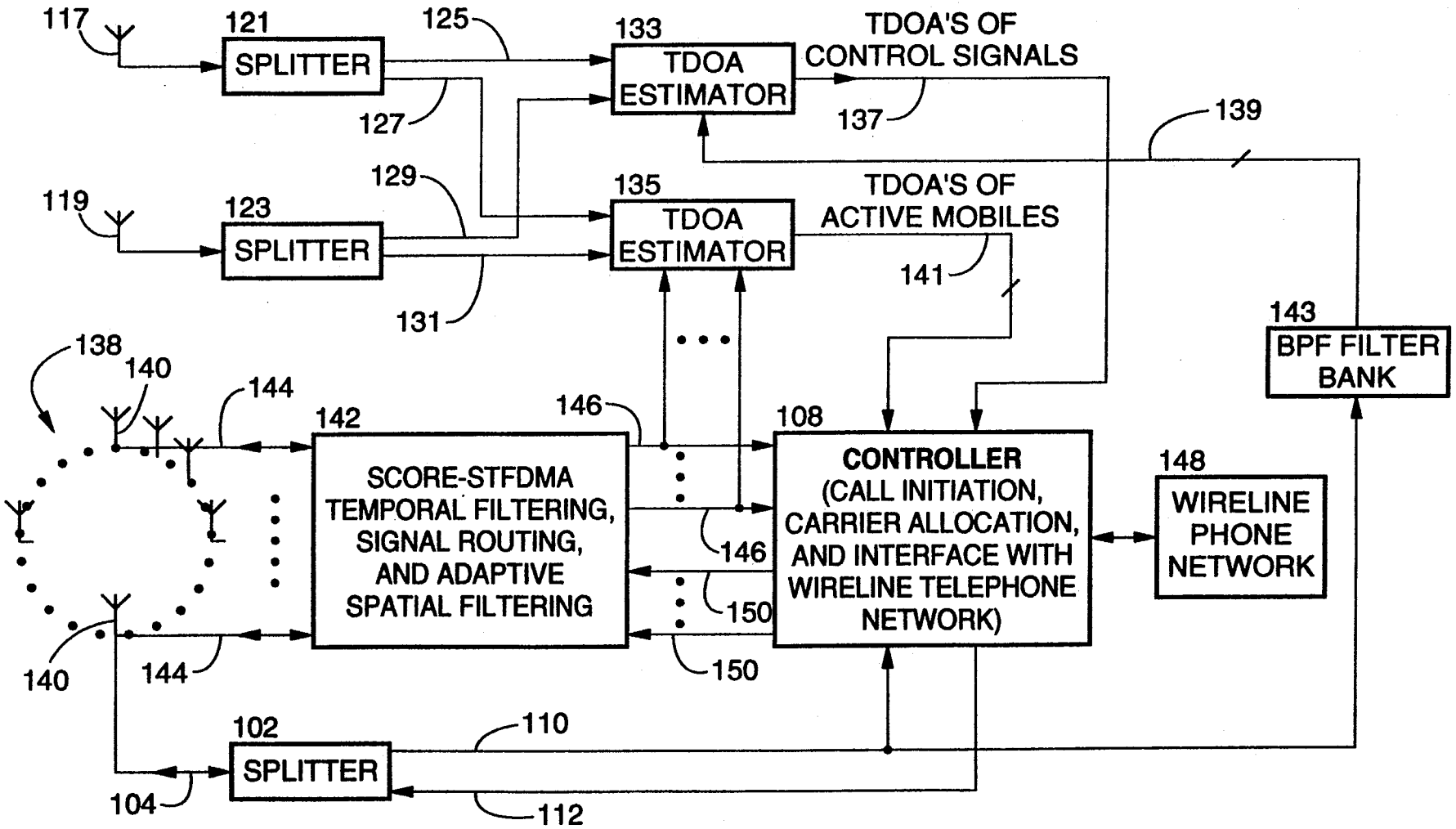
FIG. 7 is a functional block diagram of an alternative embodiment of an overall communications system employing the present invention.

FIG. 7 shows an alternative embodiment of an overall communications system employing the present invention. Elements 102, 104, 108, 110, 112, 138, 140, 142, 144, 146, 148, and 150 in FIG. 7 are identical to the corresponding elements in FIG. 6. The embodiment shown in FIG. 7 differs from that shown in FIG. 6 in the details of how the directions of arrival of the active mobile units and control signals are determined. Elements 117, 119, 121, 123, 125, 127, 129, 131, 133, 135, 137, 139, 141, and 143 shown in FIG. 7 comprise alternate means for estimating the directions of arrival. Two auxiliary antennas 117, 119 are located in different areas of the cell and should be as far as possible from the base station. Splitters 121, 123 are similar in configuration to splitters 102 previously described and separate the signals received at antennas 117 and 119 into control signals and signals from active mobile units. The outputs of splitters 121, 123 are separately coupled to two TDOA estimators 133, 135 through interconnections 125, 127, 139, and 131 as shown. TDOA estimators 133, 135 can be seen in more detail in FIG. 16. The TDOA estimators measure the DOA's using methods that differ from the methods used in the DOA estimators 128, 132 shown in FIG. 6. The received control signals are routed from splitter 102 through interconnection 110 to a bank of bandpass filters 143 that splits their inputs into a plurality of control signals occupying disjoint spectral bands and routes them through interconnection 139 to TDOA estimator 133. The resulting DOA's of the control signals are coupled through interconnection 137 to the controller 108. The received and spatially filtered signals of the active mobile users are routed through interconnections 146 to TDOA estimator 135. The resulting DOA's of the active mobile users are coupled through interconnections 141 to the controller 108.

For normal communications, the users' signals are preferably received and transmitted using an antenna array 138 (for example, a circular array) which contains M antennas 140 (for example, omnidirectional antennas). Antennas 140 are coupled to SCORE-STFDMA module 142 through interconnections 144, there being one input (output) for each antenna M. SCORE-STFDMA module 142 performs the temporal filtering, signal routing, and adaptive spatial filtering functions of the system. SCORE-STFDMA module 142 has a plurality of output lines 146 to route communications from the users to the wireline phone network 148, and a plurality of input lines 150 to receive communications from the wireline phone network 148 for transmission to the users. Controller 108 provides the interface to the wireline phone network 148.

Figure 8:
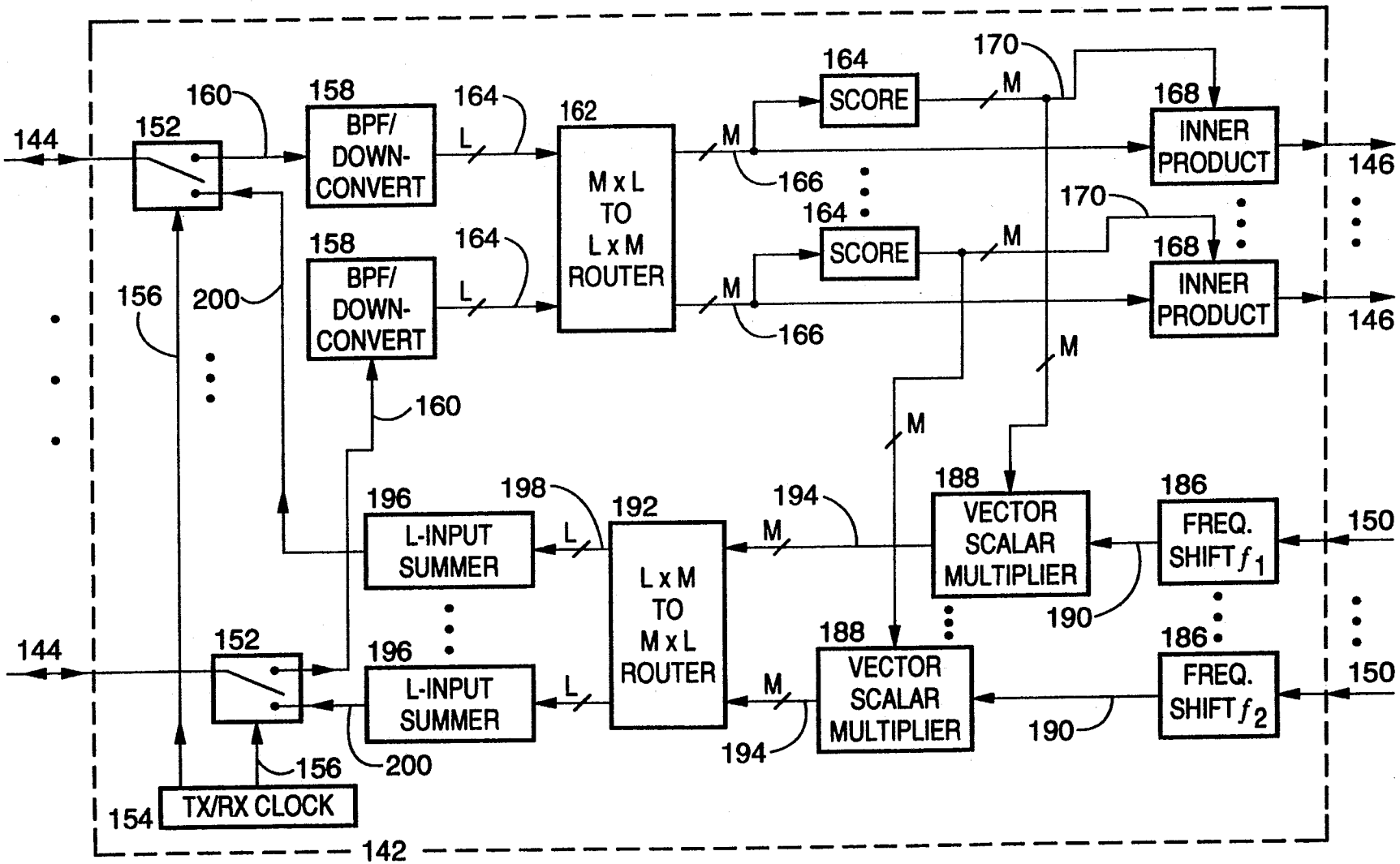
FIG. 8 is a schematic block diagram of one embodiment of the temporal filtering, signal routing and adaptive spatial filtering element shown in FIG. 6 and FIG. 7.

Referring now to FIG. 8, SCORE-STFDMA module 142 includes a transmit/receive switch 152 for each of its connections to an antenna 140. Transmit/receive switches 152 are coupled to a clock 154 which controls the time division multiplexing windows of the transmitted and received signals through interconnections 156. Signals received from a particular antenna 140 are subjected to bandpass filtering, quadrature downconversion and sampling by a processing module 158 through interconnections 160. The output of each processing module 158 contains information for each of the L users of the system received on a particular antenna. Since there are M antennas in the base station antenna array 138, it is necessary to select each of M received signals for a particular user and route them for processing. This is performed by router 162 which is coupled to processing module 164 through interconnections 164.

The output of router 162 contains, for each user, the signals from each of the M antennas. For each user therefore, there are M signal components which must be processed by a SCORE processor 164 which is coupled to router 162 through interconnections 166. SCORE processor 164, which has M outputs and inputs, determines the weight vector w for each user's signals as previously described. The outputs of a SCORE processor 164 are then applied to that user's received signals in an inner product multiplier 168 which is coupled to the SCORE processor 164 through interconnections 170. There, the signals are also summed and the composite signal is output to controller 108 on an interconnection 146.

FIG. 13 schematically shows an inner product multiplier 168. The output signals on interconnections 146 are represented by $w^H x(n)$ for the particular user.

Figure 9:
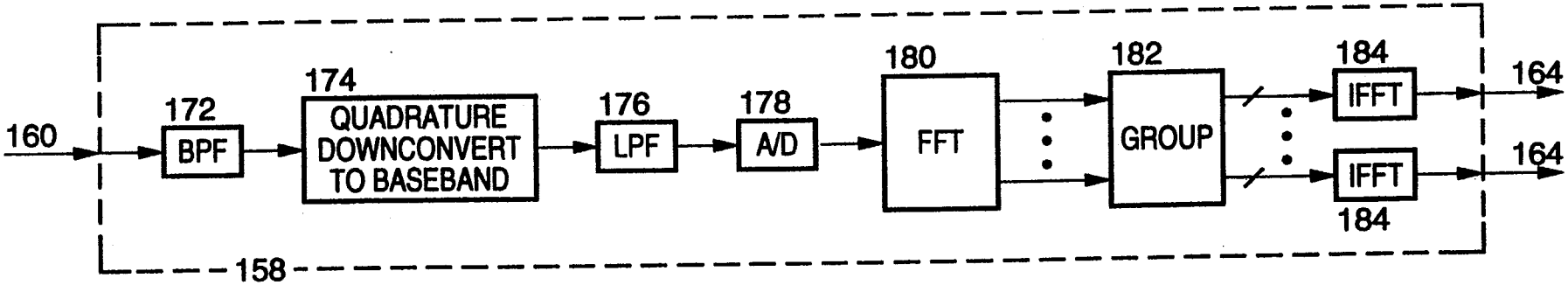
FIG. 9 is a schematic block diagram of one embodiment of a bandpass filtering and downconversion element shown in FIG. 8.

Referring now to FIG. 9, processing module 158 includes a bandpass filter 172 which is coupled to a quadrature downconverter 174 for conversion to baseband for preconditioning and anti-aliasing. The resultant signal is filtered by low pass filter 176 and converted into digital data by analog to digital convertor 178. Transformation module 180 performs a 1024-point Fast Fourier Transform to split the band into 1024 bands which are 1 Khz wide. Grouping module 182 groups the bands into 64 Khz subbands prior to a 64-point inverse Fast Fourier Transform by inverse transformation modules 184. Therefore, the function of processing module 158 is typically to split a spectral band having a width of 1024 Khz into several overlapping bands having a width of 64 Khz whose centers are separated by 1 Khz.

Referring again to FIG. 8, digital information which is to be transmitted to the user is input to SCORE-STFDMA module 142 through interconnections 150. Modulators 186 place that data on the carrier signal assigned to the user. Modulators 186 are coupled to vector scalar multipliers 188 through interconnections 190, where the weight vector w is applied to the transmitted signal. In other words, the weight vector w developed from that user's received signal by the SCORE processors 164 is used to condition the transmitted signal and separate it into components which will be separately routed to the M antennas in antenna array 138. FIG. 12 schematically shows a typical vector scalar multiplier used herein.

Vector scalar multipliers 188 are coupled to an L×M to M×L router 192 through interconnections 194. Router 192 takes the M signal components for each user and reorganizes that information so that each antenna 140 will have the its corresponding information for all users. L-input summers 196, which are coupled to router 192 through interconnections 198, sum the signal information for all users for a given antenna so that the composite signal can be transmitted through transmit/-receive switches 152 through interconnections 200 and on to antennas 140.

FIG. 11 shows a schematic of a typical L-input summer used with the present invention. FIG. 14 shows an example of a 3×2 to 2×3 router configuration which can be expanded to any number of users and antennas.

Once all of the signals are applied to the antennas in antenna array 138, the radiation pattern of the signal transmitted to the user will match the reception pattern of the signal received from the user as that signal impinged on the antenna array 138.

Figure 15:
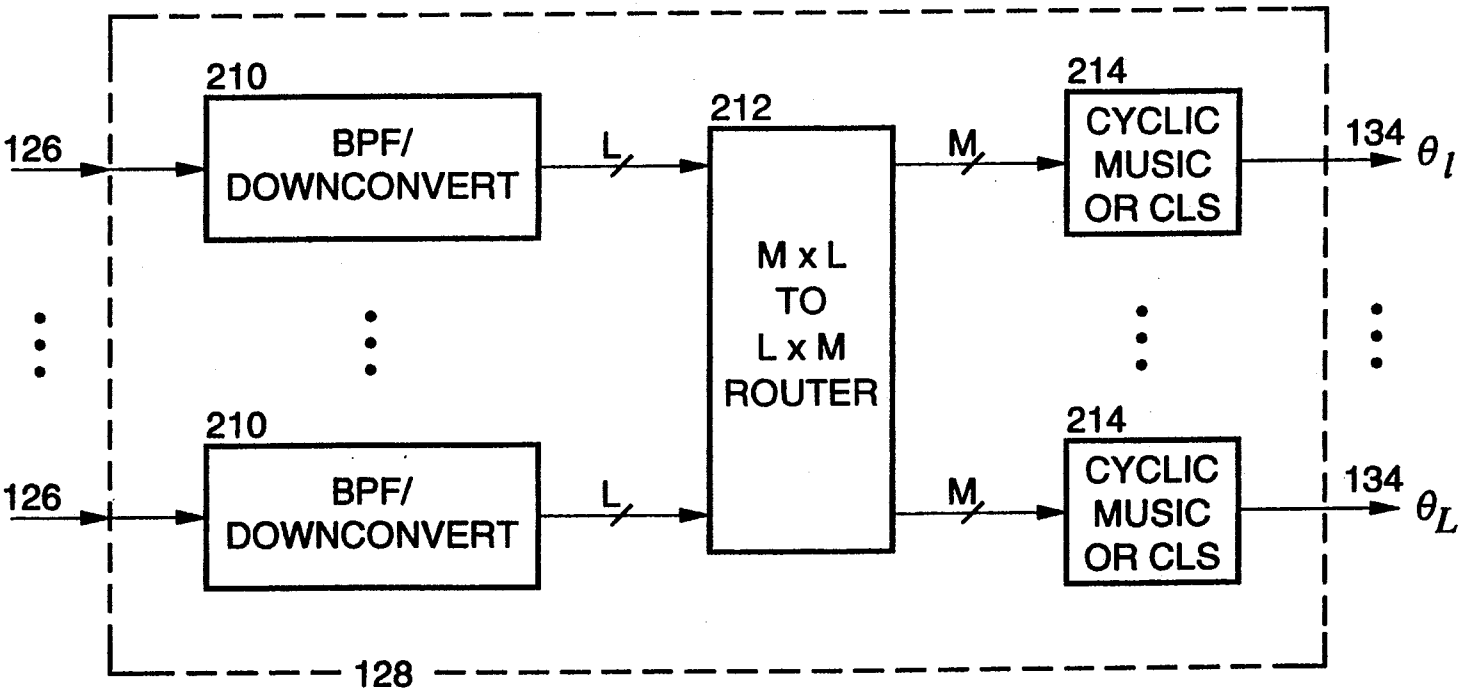
FIG. 15 is a schematic block diagram of one embodiment of a direction of arrival estimator element shown in FIG. 6.

Referring to FIG. 15, one embodiment of a DOA estimator 128 is shown (which is the same as for DOA estimator 132). Bandpass filtering and downconversion is performed by filter/converter module 210 and signals are routed through an M×L to L×M router 212. The directions of arrival $\theta$ are determined by DOA processors 214 using, for example, the Cyclic MUSIC or CLS methods previously described.

Figure 16:
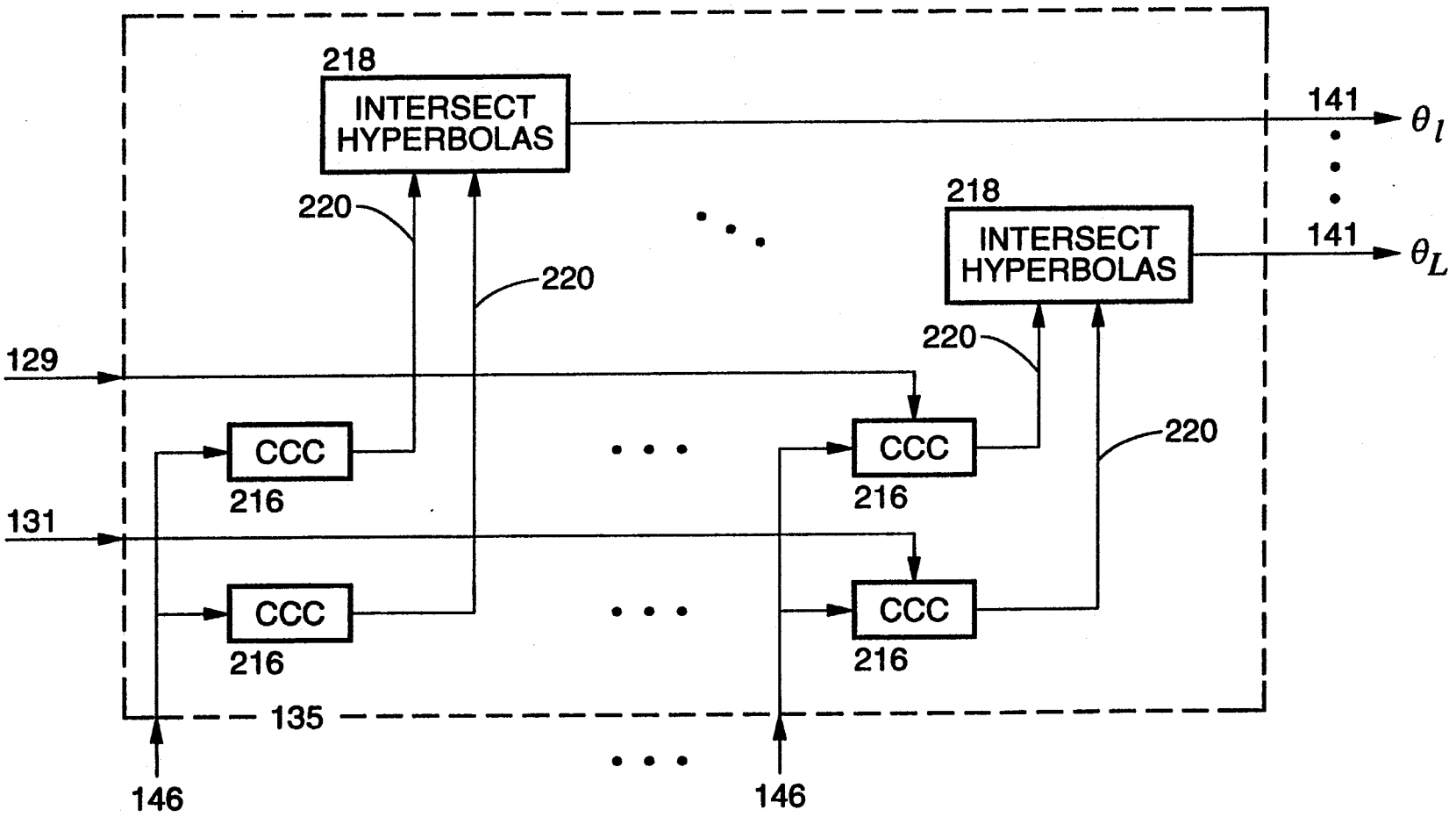
FIG. 16 is a schematic block diagram of one embodiment of a time difference of arrival estimator elements shown in FIG. 7.

Referring to FIG. 16, one embodiment of TDOA estimator 135 is shown (which is the same for TDOA estimator 133). Each CCC processor 216 (which implements in a straightforward manner the CCC method previously described) measures the TDOA between a signal on interconnections 129, 131 from an auxiliary antenna and a signal on interconnections 146 from the SCORE-STFDMA processor 142. The two TDOA estimates from a pair of CCC processors interconnected to a particular signal line in interconnections 146 are routed via interconnections 220 to a hyperbola intersect processor 218 that combines the two TDOA estimates to form a DOA estimate as previously described in conjunction with the description of the CCC method. The resulting DOA estimates from the plurality of hyperbola intersect processors 218 are routed out of TDOA estimator 135 on interconnections 141.

For the purpose of comparing the potential increase in capacity due to the SCORE-STFDMA method of the present invention relative to the analog FM-FDMA, TDMA, and CDMA schemes previously described, consider a total system-bandwidth of $B_t = 1.25$ Mhz. In the following comparison, the number of channels needed by each user in the analog FM-FDMA, TDMA, and CDMA schemes is two (one for transmission and one for reception), and one channel is needed by each user in the present invention because transmission and reception are multiplexed in time. With FM-FDMA, using a channel bandwidth of 30 Khz, 2 channels per user, and a cell reuse factor of 7 yields 3 users per cell. With TDMA, using a channel bandwidth of 30 Khz with three time slots for TDMA, 2 channels per user, and a cell reuse factor of 4 yields 15 users per cell. With CDMA, using 2 channels per user, a frequency reuse factor of 1, sectorization of 3, and voice activity factor of $\frac{3}{8}$ yields 120 channels per cell or 60 users per cell. With the SCORE-STFDMA method of the present invention, using a channel bandwidth of 32 Khz, 1 channel per user, a cell reuse factor of 3, and a carrier separation of 1 Khz yields up to 385 users per cell. Decreasing the carrier separation to 500 Hz allows up to 770 users per cell at the expense of doubling the number of antennas. By decreasing the frequency reuse factor from three to one, the user capacity would triple.

Accordingly, it will be seen that this invention provides for significant increases in user capacity of radio communications systems by space, time and frequency multiplexing of communications signals. The spatial filtering method of the present invention blindly adapts an array of antennas in accordance with the reception pattern of a signal received from a mobile or portable unit by restoring its spectral coherence. To accomplish this, the signal is correlated with a time and frequency shifted version of itself. The resultant weighting factors that realize the reception pattern of the signal are also applied to the signal to be transmitted to the mobile or portable unit, whereby the reception pattern of the user's signal is reproduced in the radiation pattern of the signal transmitted to the user. This results in radiation of maximum power to the user and minimum power to unintended users, by combining directivity with multipath radiation.

Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A method of spatially filtering spectrally overlapping communications signals, comprising the (a) receiving a plurality of radio frequency signals on an array of antennas;

(b) determining an optimum reception pattern for a signal of interest in said received signals as said received signals impinge on said array of antennas by restoring the spectral self-coherence of said signal of interest, said signal of interest corresponding to communications from a specified user; and (c) transmitting a signal to said user, said transmitted signal having a radiation pattern from said array of antennas substantially identical to said reception pattern of said signal of interest.

2. The method recited in claim 1, further comprising the step of time division multiplexing steps (a) through (c).

3. The method recited in claim 1, further comprising the step of modulating said transmitted signal with digital data.

4. The method recited in claim 3, wherein said transmitted signal is modulated with binary phase shift keying.

5. The method recited in claim 1, further comprising the step of concurrently performing steps (a) through (c) for a plurality of users.

6. The method recited in claim 1, wherein said step of determining the optimum reception pattern for a signal of interest in said received signals as said received signals impinge on said array of antennas by restoring the spectral self-coherence of said signal of interest includes the step of computing a weight vector w representing a set of weights that realize said reception pattern for said signal of interest where w is the solution to $$R_{xx^*}^{\alpha}(\tau)R_{x^*x^*}^{-1}R_{xx^*}^{\alpha H}(\tau)w_1=\lambda_1 R_{xx}w_1$$

where $\alpha$ is the cycle frequency, $R_{xx^*}^{\alpha}(\tau)$ is the conjugate cyclic autocorrelation matrix at lag $\tau$ for the vector x(t) of said received signals, $R_{xx^*}^{\alpha H}(\tau)$ is its Hermetian transpose, $R_{xx}$ is the autocorrelation matrix for x(t) at lag zero, $R_{x^*x^*}^{-1}$ is the inverse of the autocorrelation matrix for the conjugated vector $x^*(t)$ of said received signals, and $w_1$ is the solution to this eigenequation corresponding to the largest eigenvalue $\lambda_1$.

7. The method recited in claim 6, further comprising the steps of:

(a) computing the inner product of said signal of interest and said weight vector w; and (b) extracting communications data from said user from said inner product.

8. The method recited in claim 7, further comprising the step of computing the scalar vector product of said weight vector w and said transmitted signal.

9. A method for multiplexing communications signals having overlapping spectral bands, comprising the steps of:

(a) receiving a plurality of digital radio communications signals on an array of antennas, each of said communications signals having a distinct carrier frequency corresponding to a specified user;

(b) identifying a signal of interest from said plurality of communications signals using the carrier frequency of said signal of interest, said signal of interest corresponding to communications from a specified user;

(c) determining a weight factor for each antenna in said array of antennas through spectral coherence restoral for said signal of interest to realize an optimum reception pattern for said signal of interest and the remainder of interfering signals in said plurality of signals; and (d) transmitting a signal to said user over said array of antennas, said transmitted signal adjusted at each of said antennas by the corresponding weight factor, whereby the radiation pattern of said transmitted signal from said array of antennas is substantially identical to said reception pattern for said received signal of interest.

10. The method recited in claim 9, further comprising the steps of:

(a) determining discrete weight factors for each of said communications signals received at each of said antennas through spectral coherence restoral of said communications signals; and (b) transmitting a plurality of communications signals over said array of antennas, each of said transmitted signals having a radiation pattern substantially identical to said reception pattern of the corresponding signal received at said array of antennas.

11. The method recited in claim 9, further comprising the step of temporally separating said received signals from said transmitted signals.

12. The method recited in claim 9, wherein the step of determining a weight factor for each antenna in said array of antennas through spectral coherence restoral of said signal of interest comprises the step of computing a weight vector w representing a set of weights corresponding to the optimum reception pattern of said signal of interest where w is the solution to $$R_{xx^*}^{\alpha}(\tau)R_{x^*x^*}^{-1}R_{xx^*}^{\alpha H}(\tau)w_1=\lambda_1 R_{xx}w_1$$

where $\alpha$ is the cycle frequency, $R_{xx^*}^{\alpha}(\tau)$ is the conjugate cyclic autocorrelation matrix at lag $\tau$ for the vector x(t) of said received signals, $R_{xx^*}^{\alpha H}(\tau)$ is its Hermetian transpose, $R_{xx}$ is the autocorrelation matrix for x(t) at lag zero, $R_{x^*x^*}^{-1}$ is the inverse of the autocorrelation matrix for the conjugated vector $x^*(t)$ of said received signals, and $w_1$ is the solution to this eigenequation corresponding to the largest eigenvalue $\lambda_1$.

13. A method of reducing co-channel interference between radio communications signals, comprising the steps of:

(a) initiating radio communications between a user and a base station coupled to an array of antennas;

(b) determining if radio communications signals transmitted from said user to said base station are spatially separable from signals transmitted by other users to said base station;

(c) allocating to a user with a spatially separable signal a distinct communications channel which spectrally overlaps that of another user;

(d) allocating to a user with a spatially non-separable signal a distinct communications channel which is spectrally disjoint with those of other users;

(e) receiving communications signals from a plurality of users on said array of antennas;

(f) determining the optimum reception patterns of each of said received signals at said array of antennas; and (g) transmitting signals from said base station to said users wherein the radiation pattern of the signal transmitted to a user corresponds to the optimum reception pattern of the signal received from that user at said base station.

14. The method recited in claim 13, further comprising the step of restoring the spectral coherence of said received signals to adapt said array of antennas.

15. The method recited in claim 14, wherein the step of restoring the spectral coherence of said received signals to adapt said array of antennas comprises the step of computing a weight vector w representing a set of weights corresponding to the optimum reception pattern of said signal of interest where w is the solution to $$R_{xx^*}^{\alpha}(\tau)R_{x^*x^*}^{-1}R_{xx^*}^{\alpha H}(\tau)w_1=\lambda_1 R_{xx}w_1$$

where $\alpha$ is the cycle frequency, $R_{xx^*}^{\alpha}(\tau)$ is the conjugate cyclic autocorrelation matrix at lag $\tau$ for the vector x(t) of said received signals, $R_{xx^*}^{\alpha H}(\tau)$ is its Hermetian transpose, $R_{xx}$ is the autocorrelation matrix for x(t) at lag zero, $R_{x^*x^*}^{-1}$ is the inverse of the autocorrelation matrix for the conjugated vector $x^*(t)$ of said received signals, and $w_1$ is the solution to this eigenequation corresponding to the largest eigenvalue $\lambda_1$.

16. An apparatus for spatial multiplexing of communications signals, comprising:

(a) a plurality of antennas arranged in an array;

(b) receiving means for receiving radio frequency signals, said receiving means coupled to said array of antennas;

(c) spectral coherence processor means for restoring spectral coherence of signals received by said array of antennas and generating weight factors for each of said antennas, said processor means coupled to said receiving means;

(d) transmitting means for transmitting radio frequency signals, said transmitting means coupled to said array of antennas; and (e) means for adapting radio frequency signals transmitted from said transmitting means by said weight factors, whereby the radio frequency radiation pattern of a signal transmitted to a user corresponds to the optimum reception pattern for the signal transmitted by said user measured at said array of antennas.

17. The apparatus recited in claim 16, further comprising means for time division multiplexing said received signals and said transmitted signals.

18. The apparatus recited in claim 17, further comprising means for allocation of spectrally overlapping communications channels to users having spatially separable signals.

19. The apparatus recited in claim 18, further comprising means for allocation of spectrally disjoint communications channels to users having spatially non-separable signals.

20. The apparatus recited in claim 19, further comprising signal conditioning means for bandpass filtering and quadrature downconversion of said received signals, said signal conditioning means coupled to said array of antennas.

21. A space, time and frequency multiplexed communications system, comprising:

(a) a base station, said base station including an array of antennas;

(b) call initiation and control means for establishing a radio frequency link between said base station and a plurality of users;

(c) direction of arrival estimating means for estimating the direction of arrivals of radio frequency signals transmitted from said users to said base station and the multipath reflections of said signals;

(d) channel allocation means for allocating spectrally overlapping communications channels to users having spatially separable signals and allocating spectrally disjoint communications channels to users having spatially non-separable signals; and (e) adapting means for adapting said array of antennas using spectral coherence properties of said received signals; and (f) transmission means for transmitting signals to said users, said signals emanating from said array of antennas, the radiation pattern of a signal intended for a given user being substantially identical to the optimum reception pattern for the signal received from said user at said array of antennas.

* * * * *